US005881401A

United States Patent [19]

Saputo

[11] Patent Number: 5,881,401

[45] Date of Patent: Mar. 16, 1999

[54] TURBO RETURN FITTING FOR A SWIMMING POOL

[76] Inventor: John I Saputo, 29 Timbercrest La., South Setauket, N.Y. 11720

[21] Appl. No.: 863,255

[22] Filed: May 27, 1997

[51] Int. Cl.[6] ..... E04H 4/16

[52] U.S. Cl. ..... 4/490; 239/390; 239/394

[58] Field of Search ..... 4/490; 239/390, 239/394, 596

[56] References Cited

U.S. PATENT DOCUMENTS

| | | | |
|---|---|---|---|
| 578,706 | 3/1897 | Adams | 239/394 |
| 630,468 | 8/1899 | Quayle | 239/394 X |
| 4,114,206 | 9/1978 | Franc | 4/490 |

*Primary Examiner*—Robert M. Fetsuga
*Attorney, Agent, or Firm*—Michael I. Kroll

[57] ABSTRACT

A turbo return fitting for placement in a swimming pool including a side wall, a bottom wall, a return port having an internal thread extending from the side wall, a skimmer port positioned on a side of the side wall of the swimming pool opposite the return port and a gutter extending around a top of the side wall. The turbo return fitting includes an adjustable tubular body including a first end having an external thread spiraling therearound for mating with the internal thread in the return port and a second end having an external thread spiraling therearound. An adjustable spray nozzle including a spray template having perforations for controlling a flow pattern and pressure of water flowing therethrough is connected to the adjustable tubular body. The adjustable tubular body is rotatable about the return port between a first position directing said spray nozzle toward the bottom wall for cleaning the bottom wall; a second position directing said spray nozzle toward the side wall for cleaning the side wall; a third position directing said spray nozzle toward the top of the swimming pool for creating a fountain effect; and a fourth position directing said spray nozzle toward a surface of the water in the swimming pool to skim the surface of the pool. The spray template is adjustable to maximize the effect of the turbo return device.

1 Claim, 6 Drawing Sheets

TURBO RETURN FITTING FOR A SWIMMING POOL

BACKGROUND OF THE INVENTION

1. Field of the Invention

The instant invention relates generally to equipment for swimming pools and, more specifically, to a turbo return fitting for use in returning water to and cleaning a swimming pool.

2. Description of the Prior Art

Numerous types of equipment for use in returning water to swimming pools have been provided in the prior art. For example, U.S. Pat. No. 4,393,526 is illustrative of such prior art While this unit may be suitable for the particular purpose to which it addresses, it would not be as suitable for the purposes of the present invention as heretofore described.

U.S. Pat. No. 4,393,526

Inventor: Paul B. Miller et al.

Issued: Jul. 19, 1983

A pool cleaning apparatus characterized by a long, hollow main body coupled to a pressurized swimming pool inlet and supporting a pair of cleaning hoses, a pressure relief valve, and an adjustable nozzle for producing a surface current A primary cleaning hose sweeps the side and bottom surfaces of the pool, and a secondary cleaning hose follows up after the primary cleaning hose. The adjustable nozzle is used to direct a jet of water towards the surface of the water contained by the pool to create surface currents which urge floating debris towards the swimming pool's skimmers. The pressure relief valve controls the strength and vigor of the cleaning action of the apparatus.

BRIEF SUMMARY OF THE INVENTION

The present invention is concerned with equipment for swimming pools and, more specifically, to a turbo return system for returning water to and cleaning swimming pools.

A primary object of the present invention is to provide a turbo return fitting for a swimming pool that will overcome the shortcomings of prior art devices.

Another object of the present invention is to provide a turbo return fitting for a swimming pool that is adjustable and coupled to the return port in the side wall of a pool for cleaning the side walls, bottom wall and skim the top surface of the water thereby reducing the frequency with which the swimming pool must be vacuumed and cleaned.

A further object of the present invention is to provide a turbo return fitting for a swimming pool able to produce a fountain effect during return of water to the swimming pool.

A still further object of the present invention is to provide a turbo return fitting for a swimming pool including a plurality of interchangeable nozzle heads for varying the flow pattern and pressure with which water is returned to the swimming pool.

Another object of the present invention is to provide a turbo return fitting for a swimming pool that is simple and easy to use.

A further object of the present invention is to provide a turbo return fitting for a swimming pool that is economical in cost to manufacture.

A turbo return fitting for placement in a swimming pool including a side wall, a bottom wall, a return port having an internal thread extending from the side wall, a skimmer port positioned on a side of the side wall of the swinming pool opposite the return port and a gutter extending around a top of the side wall is disclosed by the present invention. The turbo return fitting includes an adjustable tubular body including a first end having an external thread spiraling therearound for mating with the internal thread in the return port and a second end having an external thread spiraling therearound. An adjustable spray nozzle including a spray template having perforations for controlling a flow pattern and pressure of water flowing therethrough is connected to the adjustable tubular body. The adjustable tubular body is rotatable about the return port between a first position directing said spray nozzle toward the bottom wall for cleaning the bottom wall; a second position directing said spray nozzle toward the side wall for cleaning the side wall; a third position directing said spray nozzle toward the top of the swimming pool for creating a fountain effect; and a fourth position directing said spray nozzle toward a surface of the water in the swimming pool to skim the surface of the pool. The spray template is adjustable to maximize the effect of the turbo return device by controlling the flow pattern and pressure at which the water returns to the swimming pool.

Further objects of the invention will become apparent as the description proceeds.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings. Attention is called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

FIG. 3 is a cross-sectional view taken along the line 3—3 of FIG. 1 illustrating the turbo return fitting of the present invention in a fourth adjustable position for skimming the top surface of the water within the swimming pool;

DESCRIPTION OF THE REFERENCED NUMERALS

Figure 1:
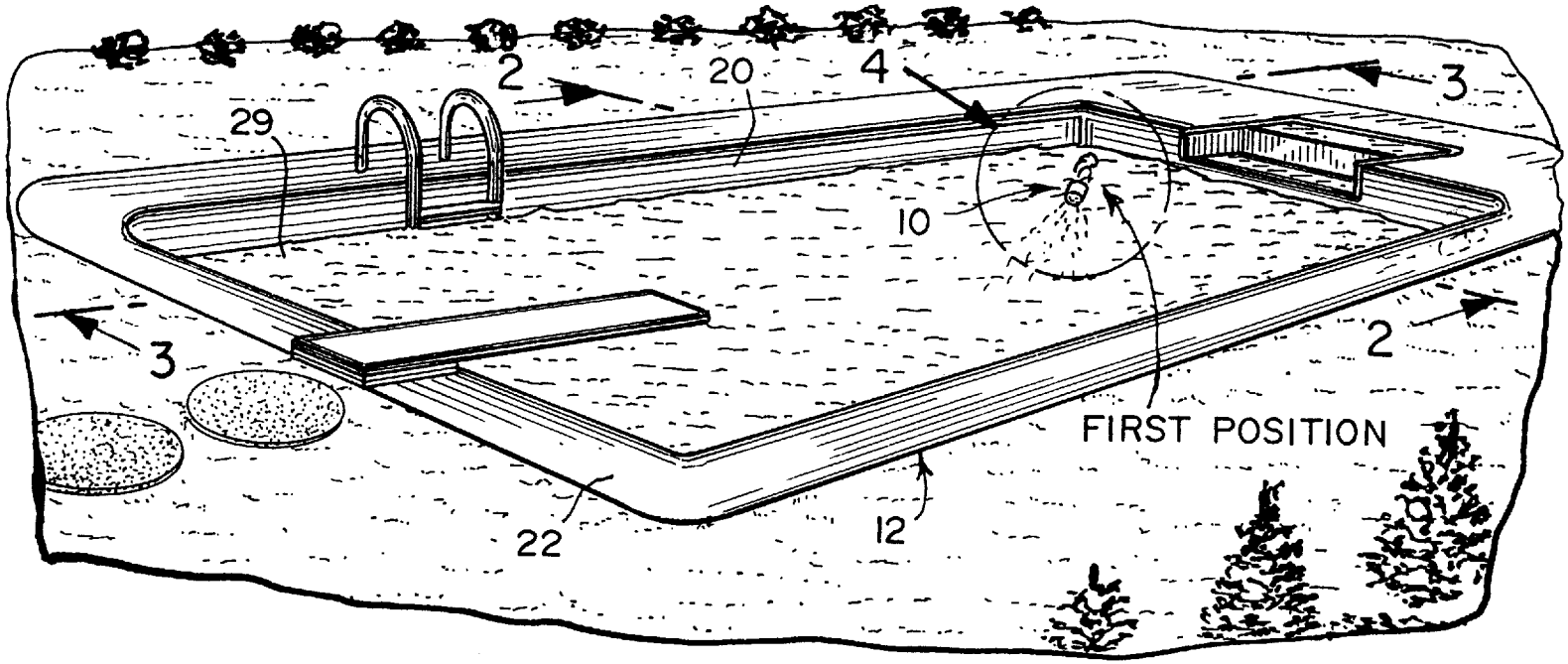
FIG. 1 is a perspective view of a swimming pool with the invention installed therein in a first adjustable position for cleaning the bottom of the pool.

Turning now descriptively to the drawings, in which similar reference characters denote similar elements throughout the several views, the Figures illustrate a turbo return fitting for a swimming pool of the present invention. With regard to the reference numerals used, the following numbering is used throughout the various drawing figures.

10 turbo return fitting
12 swimming pool
14 return port
16 internal threads within return port
18 skimmer port
19 conduit
20 side wall of swimming pool
22 gutter of swimming pool
24 bottom wall of swimming pool
26 adjustable tubular body assembly
28 adjustable spray head
29 water within swimming pool
30 ninety degree elbow pipe member
32 first end of ninety degree elbow pipe member
34 second end of ninety degree elbow pipe member
38 forty-five degree elbow pipe member
40 first end of forty-five degree elbow pipe member
42 second end of forty-five degree elbow pipe member
46 cylindrical housing of adjustable spray head
48 face of adjustable spray head
50 specific perforated pattern on face of adjustable spray head
54 external threads on first end of ninety degree elbow pipe member
56 external threads on second end of ninety degree elbow pipe member
58 external threads on first end of forty-five degree elbow pipe member
60 external threads on second end of ninety degree elbow pipe member
62 internal threads in adjustable spray head
64 collar on second end of ninety degree elbow pipe member
66 perforated filter plate in second end of ninety degree elbow pipe member
68 ribbed collar on first end of forty-five degree elbow pipe member
70 octagon shaped flange on second end of forty-five degree elbow pipe member
72 slot for holding template
74 first spray head template
76 second spray head template
78 clamp
80 fastener
82 template face
84 outlet

DETAILED DESCRIPTION OF THE PREFERRED EMBODIMENT

A preferred embodiment of the device of the present invention will now be described with reference to FIGS. 1–10 in which identical reference characters denote similar elements throughout the several views.

Figure 2:
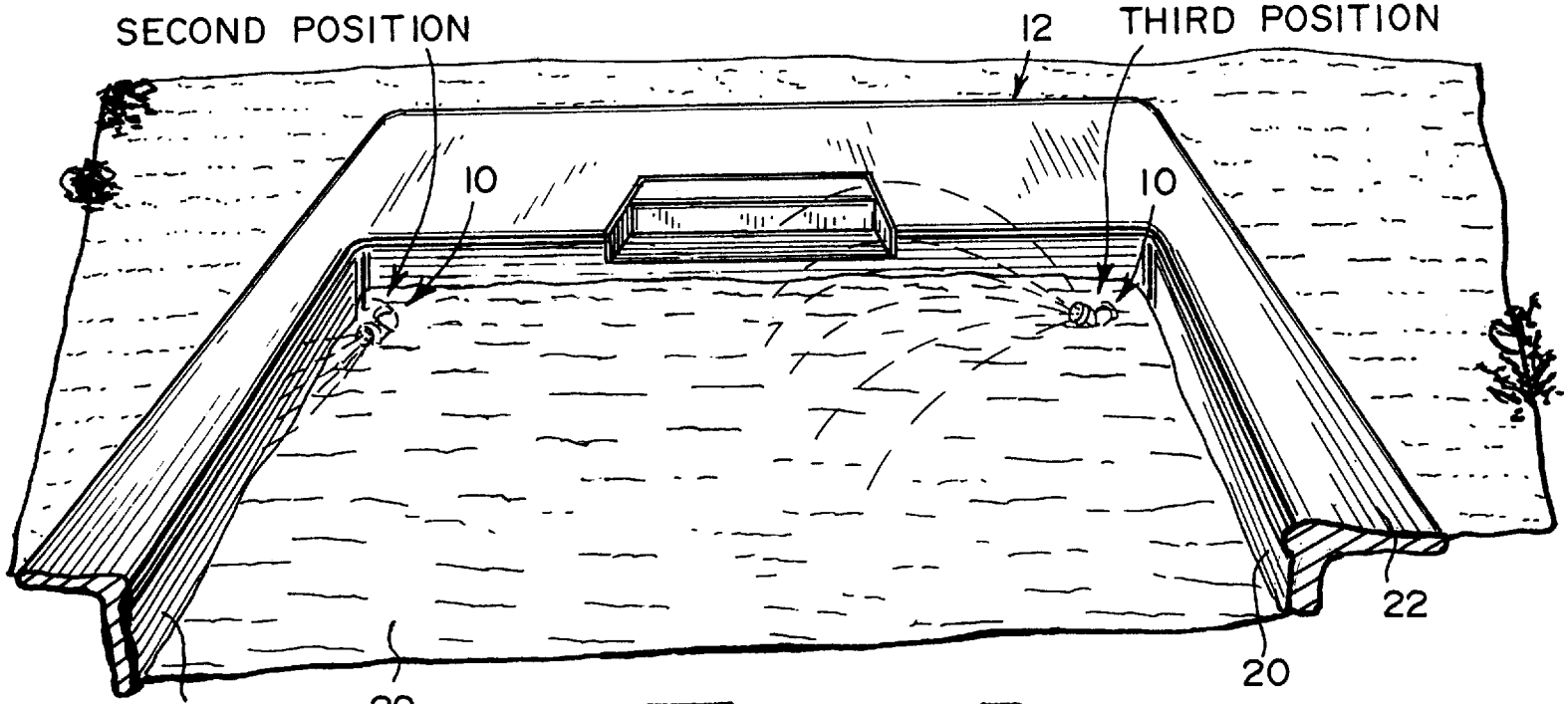
FIG. 2 is a perspective view of a portion of the swimming pool of FIG. 1 taken along the line 2—2 with the invention installed therein in a second adjustable position for cleaning a side wall of the pool and in a third adjustable position for producing a fountain.
Figure 5:
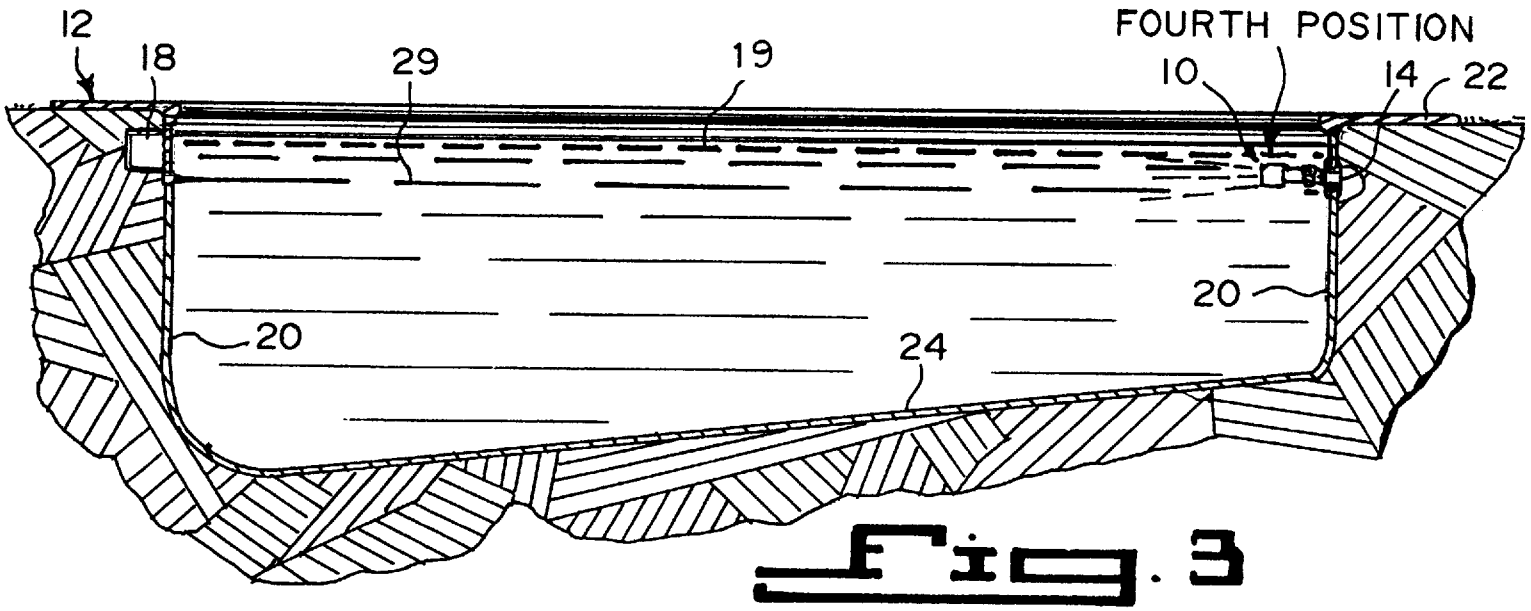
FIG. 5 is a side view of the turbo return fitting of the present invention taken in the direction of the arrow 5 of FIG. 4 with parts broken away.
Figure 4:
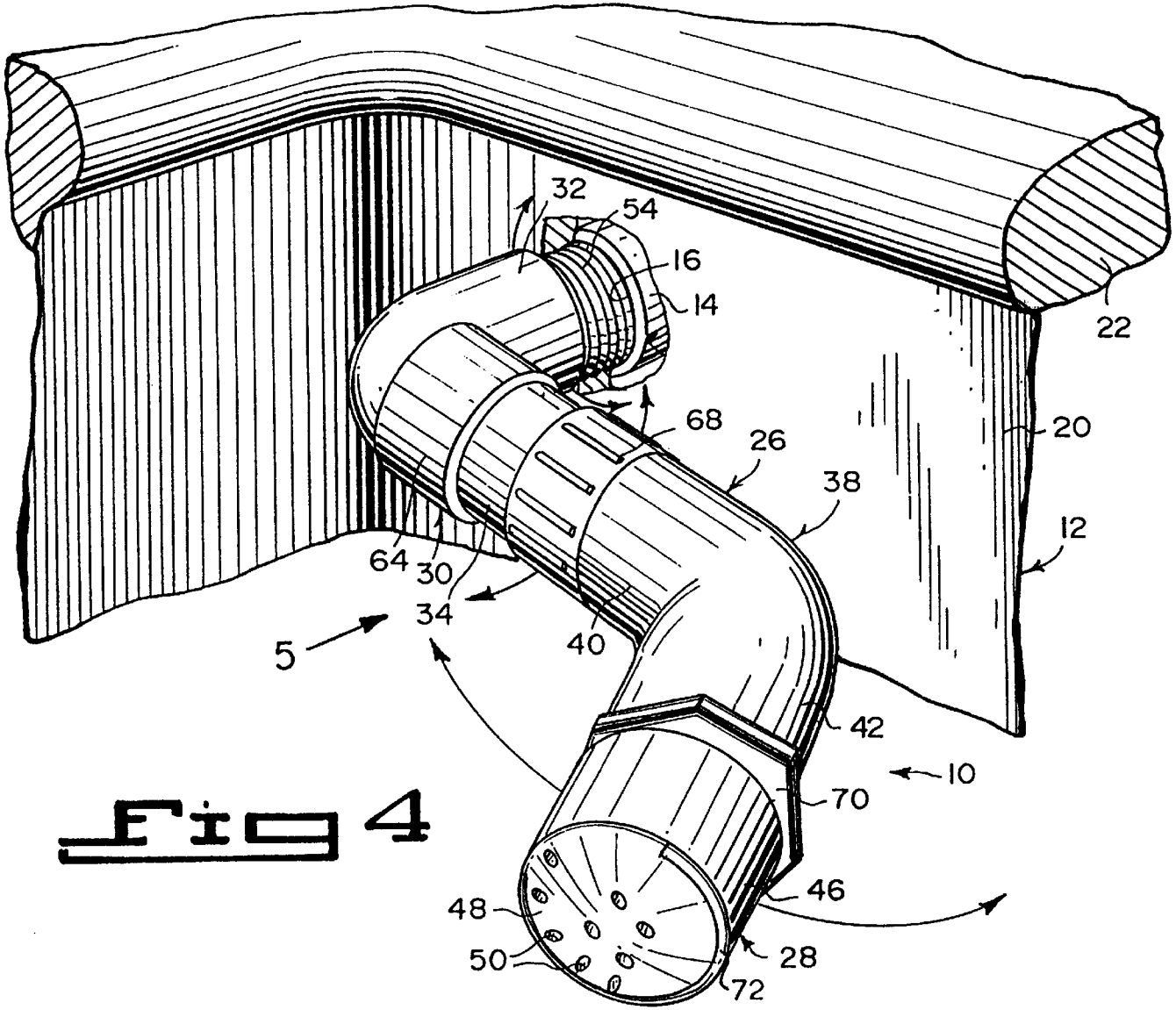
FIG. 4 is an enlarged perspective view of the turbo return fitting of the present invention within the circle labeled 4 in FIG. 1.
Figure 5:
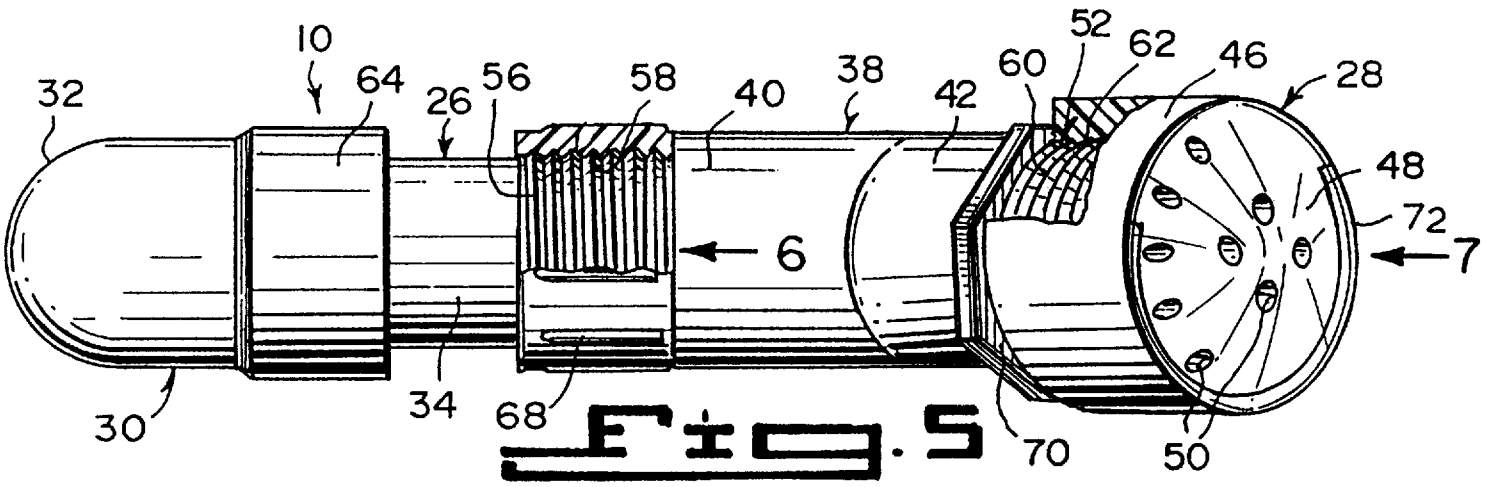
Figure 7:
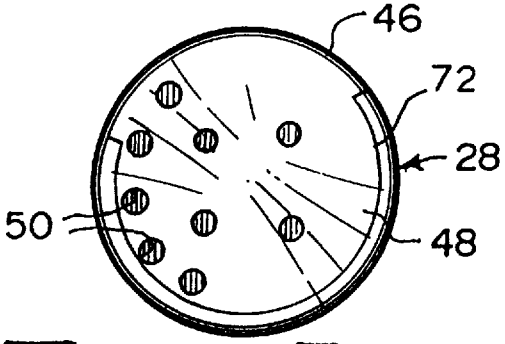
FIG. 7 is an end view of the turbo return fitting of the present invention taken in the direction of the arrow 7 of FIG. 5.
Figure 6:
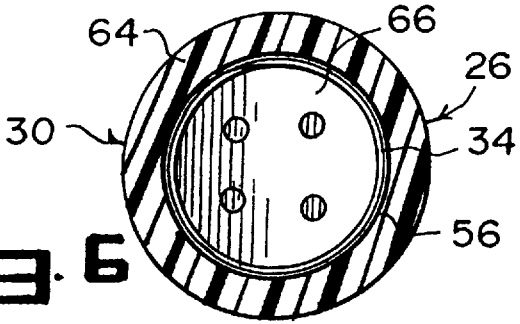
FIG. 6 is cross sectional view of the turbo return fitting of the present invention taken in the direction of the arrow 6 of FIG. 5.

Specifically, FIGS. 1 through 3 show a preferred embodiment of the turbo return fitting 10 within a swimming pool 12. The swimming pool 12 includes a return fitting 14 having internal threads 16 as illustrated in FIG. 4; a skimmer port 18 located in a side wall 20 of the swimming pool 12; a gutter 22 extending around the circumference of the swimming pool 12; and a bottom wall 24. The return fitting 14 and the skimmer port 18 are both positioned below the gutter 22 but on opposite sides of the swimming pool 12. The return fitting 14 is connected to receive water from the skimmer port 18 via a conduit 19. The swimming pool 12 is filled with water 29 which is drawn in through the skimmer port 18 and through the conduit 19 for reentry to the swimming pool 12 through the return fitting 14.

The turbo return fitting 10 includes an adjustable tubular body assembly 26 for coupling to the return port 14 and an adjustable spray nozzle 28 connected to the tubular body assembly 26. The tubular body assembly 26 includes a first elbow pipe member 30 having a ninety degree bend. A first end 32 of the elbow pipe member 30 is adjustably coupled to the return port 14. The first end 32 of the first elbow pipe member 30 includes an external thread 54 which threads into the internal thread 16 within the return port 14 and is adjustable to rotate about the return port 14. The first elbow pipe member 30 also includes a collar 64 set back on a second end 34 thereof which is gripped to rotate the first elbow pipe member 30 about the return port 14. The second end 34 of the first elbow pipe member 30 also includes an external thread 56 spiraling therearound.

A second elbow pipe member 38 having a forty-five degree bend is adjustably connected at a first end 40 thereof to a second end 34 of the first elbow pipe member 30. The second elbow pipe member 38 has an internal thread 58 within an inner side of the first end 40 thereof into which an external thread 56 spiraling around the second end 34 of the first elbow pipe member 30 is thread. The second elbow pipe member 38 is adjustable to rotate about the first elbow pipe member 30. A ribbed collar 68 is positioned about the first end 40 of the second elbow pipe member 38 and may be gripped to rotate the second elbow pipe member 38 with respect to the first elbow pipe member 30. The second elbow pipe member 38 also contains a perforated filter plate 66 located within first end 40 thereof. The perforated filter plate 66 prevents large particles within the water 29 from passing through the turbo return filter 10 and into the swimming pool 12.

The adjustable spray nozzle 28 includes a cylindrical housing 46 having an internal thread 62 therein. The internal thread 62 is threaded on an external thread 60 around the second end 42 of the second elbow pipe member 38 and thereby adjustably connected to the second end 42 of the second elbow pipe member 38. An octagon shaped flange 70 is positioned around the second end 42 of the second elbow pipe member 38 behind the external thread 60 and may be grasped to rotate the spray nozzle 28 thereabout A spray head 48 which may be varied to control the flow and pressure of water exiting the adjustable spray nozzle 28 is connected to the spray nozzle 28.

Figure 8:
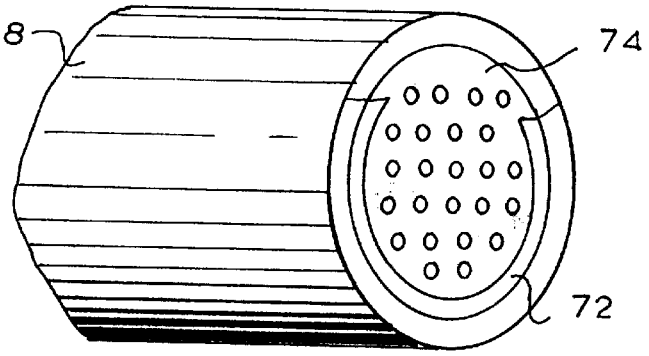
FIG. 8 is a perspective view of a first embodiment of the spray nozzle used in the turbo return fitting of the present invention.

A preferred embodiment of the adjustable spray nozzle 28 is illustrated in FIG. 8. The spray nozzle 28 includes a slot 72 for placement of a first spray head template 74 therein. The first spray head template 74 is sized to fit snugly within the slot 72 and is formed with a specific perforated flow head pattern 50. The pattern illustrated on the first spray head template 74 of FIG. 8 is for purposes of example and is not meant to be limiting. The first spray head template 74 is removable and may be replaced with an alternate spray head template having a different flow head pattern which would vary the flow pattern and pressure of water entering the swimming pool 12 via the turbo return fitting 10. This is useful as different flow patterns and pressures are more effective to perform different functions.

Figure 9:
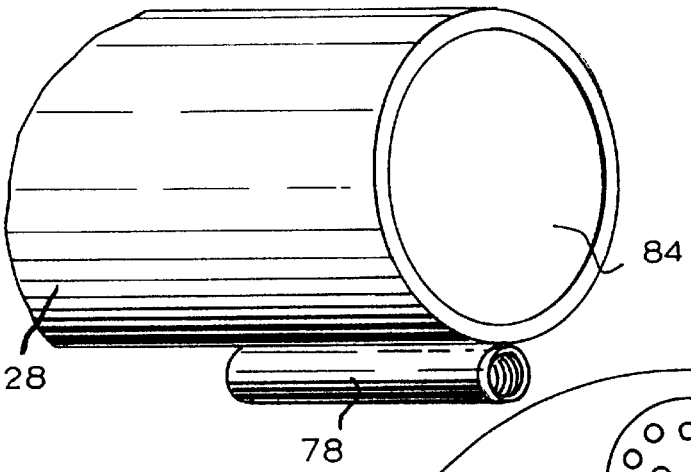
FIG. 9 is a perspective view of a second embodiment of the spray nozzle used in the turbo return fitting of the present invention.
Figure 10:
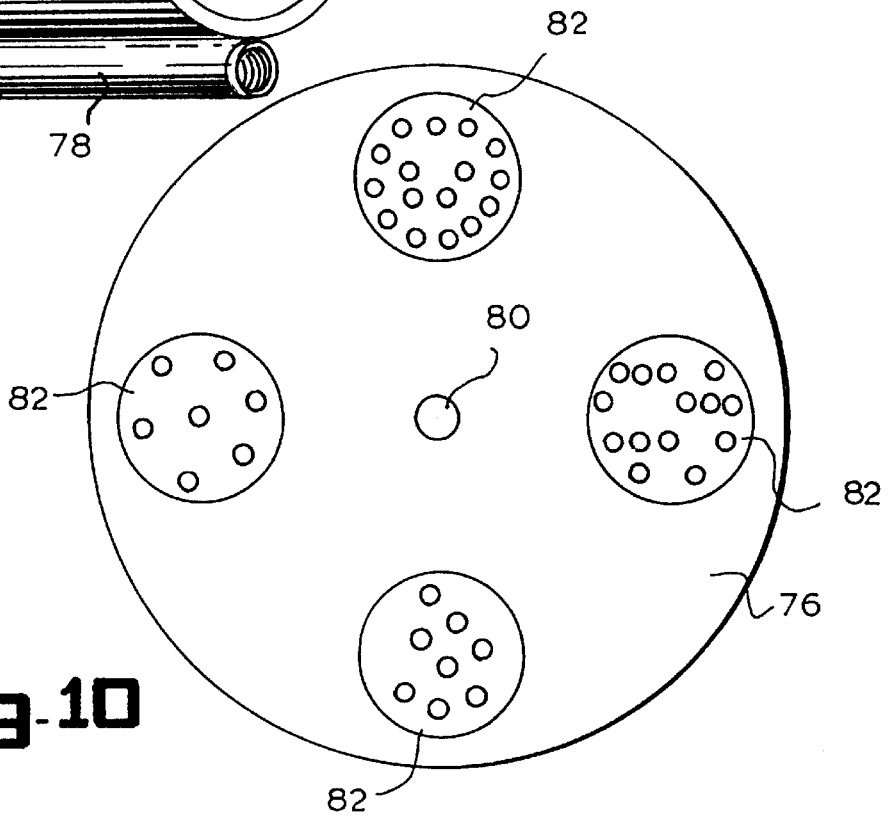
FIG. 10 is a front view of a spray head template used with the nozzle head of FIG. 9 in the turbo return fitting of the present invention.

An alternate embodiment for the spray nozzle 28 is illustrated in FIGS. 9 and 10, respectively. The spray nozzle 28 includes a fastener 78 for connection with a second spray head template 76. The second spray head template 76 includes a fastening device 80 for rotatably connecting the template 76 to the fastener 78 of the spray nozzle 28. A plurality of template faces 82 are positioned about the circumference of the second spray head template 76 each defining a different spray pattern. When fastened to cover the water outlet 84, a particular template face 82 is positioned and locked in place over the outlet 84 to define the flow pattern and water pressure. When it is desired to change the flow pattern and pressure of the water the second spray head template 76 is simply rotated until the desired template face 82 covers the water outlet 84. The selected template face 82 is then locked in place over the water outlet 84.

The tubular body assembly 26 is rotatable and can place the spray nozzle 28 in any one of a plurality of positions depending upon which surface of the swimming pool 12 is desired to be cleaned or what function is desired to be performed. A first position for cleaning the bottom 24 of the swimming pool 12 is illustrated in FIG. 1 in which the tubular body assembly 26 is rotated to direct the spray nozzle 28 towards the bottom 24 of the swimming pool 12. A second position for cleaning a side wall 20 of the swimming pool 12 is illustrated in FIG. 2 in which the tubular body assembly 26 is rotated to direct the spray nozzle towards the side wall 20 of the swimming pool 12. A third position for producing a fountain effect in the swimming pool 12 is illustrated in FIG. 2 in which the tubular body assembly 26 is rotated to direct the spray nozzle 28 to spray water above the swimming pool 12. A fourth position for cleaning a top surface of the water in the swimming pool 12 is illustrated in FIG. 3 in which the tubular body assembly 26 is rotated to direct the spray nozzle to create a flow of water towards the gutter 22 and skim the surface of the swimming pool 12.

In operation, the external thread 54 on the first end 32 of the first elbow pipe member 30 are thread into the thread 16 within the return port 14 and the internal thread 58 within the first end 40 of the second elbow pipe member 38 are thread onto the external thread on the second end 34 of the first elbow pipe member 30. The internal thread 62 within the cylindrical housing 46 of the spray nozzle 28 is then thread onto the thread 60 on the second end 42 of the second elbow pipe member 38.

A spray head template 74 is chosen depending upon the function which is desired to be performed such as cleaning a side wall, cleaning the bottom wall, creating a fountain effect or skimming the top surface of the water. The template 74 is then inserted into the slot 72. If the embodiment of FIGS. 9 and 10 is used, the spray head template 76 is connected to the spray nozzle 28 by fastening the fastener 80 connected to the spray head template 76 within the clamp 78 and the spray head template 76 is rotated until a desired template face 82 is positioned to cover the spray nozzle outlet 84.

The first elbow pipe member 30, second elbow pipe member 38 and spray nozzle 28 are then adjusted to face the spray nozzle 28 in the correct direction to perform the desired function. The spray nozzle 28 will be directed to either side thereby facing a desired side wall to be cleaned, downward to clean the bottom, upward to create a fountain effect or angled towards the surface of the water 29 to produce a skimmer effect and direct particles atop the water towards the gutter 22.

It is thus evident that the present invention provides a turbo return fitting for a swimming pool that will overcome the shortcomings of prior art devices and is adjustable and coupled to the return port in the side wall of a pool for cleaning the side walls, bottom wall and skim the top surface of the water and thereby reducing the frequency with which the swimming pool must be vacuumed and cleaned. The present invention is also able to produce a fountain effect during return of water to the swimming pool. These results are enhanced by providing a plurality of interchangeable nozzle heads for varying the flow pattern and pressure with which water is returned to the swimming pool. Furthermore, the turbo return fitting for a swimming pool of the present invention is simple and easy to use while also being economical in cost to manufacture.

It will be understood that each of the elements described above, or two or more together, may also find a useful application in other types of applications differing from the type described above.

While the invention has been illustrated and described as shown in the drawings, it is not intended to be limited to the details shown, since it will be understood that various omissions, modifications, substitutions and changes in the forms and details of the formulation illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of this invention.

What is claimed:

1. A turbo return fitting for placement in a swimming pool including a side wall, a bottom wall, a return port having an internal thread spiraling around a side wall thereof, a skimmer port positioned on a side of the side wall of the swimming pool opposite the return port and a gutter extending around a top of the side wall, said turbo return fitting consisting of:

an adjustable tubular body assembly including a first elbow pipe member having first and second ninety degree bend therein, said first and second ends each including a thread spiraling therearound, said external thread of said first end engaging the internal thread in the return port to thereby connect said turbo return fitting to the return port, a second elbow pipe member having first and second ends and a forty-five degree bend therein, said second pipe member first end including an internal thread spiraling therein and said second pipe member second end including an external thread spiraling therearound, said internal thread of said second elbow first end adjustable engaging the thread around the second end of said first elbow pipe member;

b) an adjustable spray nozzle having a water outlet and including an internal thread for mating with said external thread on the second end of said second elbow pipe member and means mounted on said water outlet for selecting and controlling a flow pattern of water flowing therethrough, wherein said adjustable tubular body assembly is adjustable to rotate about the return port between a first position directing said spray nozzle toward the bottom wall for cleaning the bottom wall, a second position directing said spray nozzle toward the side wall for cleaning the side wall, a third position directing said spray nozzle toward the top of the swimming pool for creating a fountain effect and a fourth position directing said spray nozzle toward a surface of the water in the swimming pool to skim the surface of the pool, said spray template being adjustable to maximize the effect of the turbo return device;

c) said selecting and controlling means comprising an elongated clamp member mounted on the outside of said spray head adjacent said water outlet, said clamp member having an opening thereinto substantially aligned with said outlet, a circular spray head template for being mounted for rotation on said clamp, said template having a plurality of template faces permitting the selection of a template face to be aligned with said water outlet for selecting the flow pattern to be selected;

d) a first collar positioned about said second end of said first elbow pipe member for adjusting a position of said first elbow pipe member in a rotational manner about the return port for selecting the direction of discharge of water from said spray nozzle;

e) said second elbow pipe member further includes a perforated filter positioned within said second end thereof for preventing particles larger than a predetermined size from flowing through said second elbow member;

f) a second collar positioned about said first end of said second elbow pipe member for adjusting a position of said second elbow pipe member in a rotational manner about said first elbow pipe member; and g) an octagonal shaped flange positioned about sad second end of said second elbow ripe member for adjusting a position of said spray nozzle in a rotational manner about said second elbow pipe member so that said adjustable tubular body assembly with a single spray nozzle is readily articulated into any of the aforesaid four positions.

* * * * *